United States Patent [19]

Guggenberger et al.

[11] Patent Number: 4,955,217

[45] Date of Patent: Sep. 11, 1990

[54] WIRE COILING ARRANGEMENT

[75] Inventors: Erich Guggenberger, Geneva, Switzerland; Ebbe Hodén, Mariefred, Sweden

[73] Assignee: Sunds Defibrator AB, Sundsvall, Sweden

[21] Appl. No.: 438,475

[22] PCT Filed: Jun. 13, 1988

[86] PCT No.: PCT/SE88/00319

§ 371 Date: Jan. 17, 1990

§ 102(e) Date: Jan. 17, 1990

[87] PCT Pub. No.: WO88/09763

PCT Pub. Date: Dec. 15, 1988

[30] Foreign Application Priority Data

Jun. 12, 1987 [SE] Sweden ..... 8702461-8

[51] Int. Cl.[5] ..... B21F 3/04

[52] U.S. Cl. ..... 72/134; 140/92.2

[58] Field of Search ..... 72/133, 134, 142; 140/92.2, 102

[56] References Cited

U.S. PATENT DOCUMENTS

| | | | |
|---|---|---|---|
| 2,014,833 | 9/1935 | Burns | 72/133 |
| 2,100,046 | 11/1937 | Blount | 72/134 |
| 3,847,003 | 11/1974 | Schaefer | 72/134 |

*Primary Examiner*—Lowell A. Larson

*Attorney, Agent, or Firm*—Fleit, Jacobson, Cohn, Price, Holman & Stern

[57] ABSTRACT

A wire coiling arrangement includes a rotatable wire coiling mandrel (34) which incorporates a wire receiving slot (33) which extends axially rearwardly from a forward end of the mandrel and which has a slot mouth or entrance (40) facing towards the front end of the mandrel. A coil ejection arrangement (43–46) is arranged for movement along the mandrel (34), between a withdrawn wire coiling position and a forwardly located coil ejection position, such as to push a coil wound on the mandrel axially therefrom. The coil ejection arrangement also carries wire guides (42) which in one setting position of the ejection arragement form a continuation of the slot mouth (40) which widens outwardly from the forward end of the mandrel.

7 Claims, 3 Drawing Sheets

WIRE COILING ARRANGEMENT

The present invention relates to a wire coiling arrangement intended preferably for use in a wrapping wire removing arrangement and being of the kind which includes a rotatable wire coiling mandrel incorporating a wire receiving slot which extends at least substantially axially rearwards from a forward end of the mandrel and which has a mouth part or entrance which faces towards the forward end of the mandrel, and further includes a coil ejection arrangement which can be moved relative to the mandrel between a withdrawn, wire coiling position and a forwardly located coil ejection position, for pushing a coil of wire wound on the mandrel axially therefrom.

One object of the present invention is to provide a novel wire coiling arrangement of this kind which is of simplified construction and which is a structural improvement on known wire coiling arrangements.

To this end it is proposed in accordance with the invention that the coil ejecting arrangement is movable along the mandrel and, to facilitate introduction of a wire into the wire receiving slot, that the ejection arrangement carries a wire guide device which in one positional setting of the coil ejection arrangement forms a widened continuation of the mouth part of the slot in a direction away from the forward end of the mandrel. Because the mandrel can be made immovable in the direction of its longitudinal axis, this arrangement is extremely reliable in operation and simple in construction.

Further characteristic features of the invention and advantages afforded thereby will be apparent from the depending claims and from the following description of the invention, which is made with reference to an exemplifying embodiment of the invention relating to the removal of metallic wrapping wires from bales of paper pulp while the bales rest on a conveyor path, and also with reference to accompanying drawings, in which FIG. 1 is a schematic side view of a plant for removing wrapping wires from bales while the bales rest on a conveyor path, FIG. 2 is a view of the plant shown in FIG. 1, from above;

Figure 1:
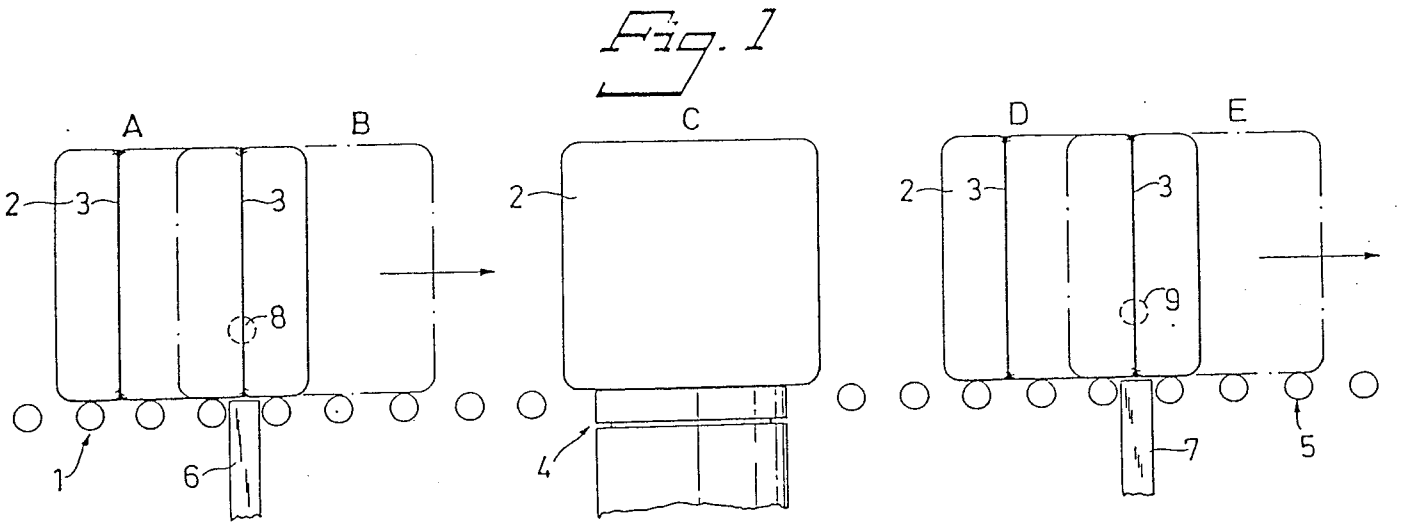
Figure 2:
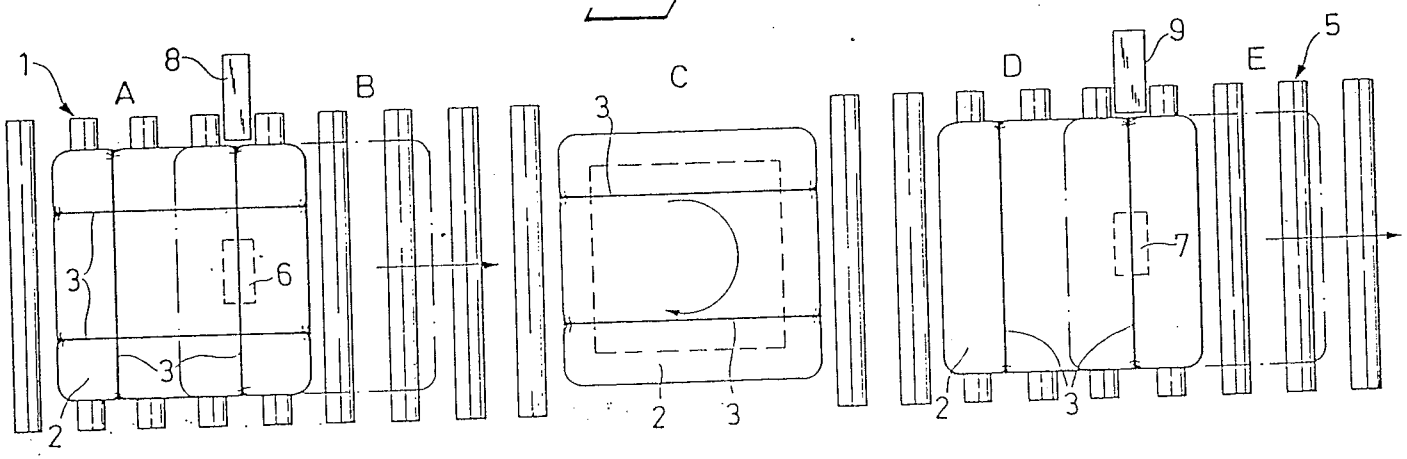

In FIGS. 1 and 2 the reference numeral identifies a first roller path 1 which carries a bale 2 of paper pulp, around which there is wrapped two pairs of mutually parallel steel wires 3, the wires 3 of one pair extending at right angles to the wires 3 of the other pair. The bale 2 is placed on the first roller path 1 in position A, as shown with the bale drawn in full lines in the Figure, and in position B, as shown with the bale drawn in chain lines, this latter bale partially overlapping the bale shown in full lines. The arrangement also includes a turntable 4, on which a bale 2 is placed in position C, and a second roller path 5, which carries a bale 2 placed in position D, in accordance with the full line figure which shows the bale 2, and in position E, in accordance with the figure drawn in chain lines, this latter figure partially overlapping the figure drawn in full lines.

The roller paths 1, 5 are illustrated schematically in the drawings and comprise mutually parallel, driven rollers, the upper surfaces of which rollers lie in one and the same plane and the common transport direction of which is arrowed in FIGS. 1 and 2 of the drawings. The turntable 4 is also illustrated schematically in the drawings and comprises an upper part which is rotatable about a vertical axis and which is provided with driving roller means, not shown in the drawings, by means of which the bale 2 can be moved in two mutually perpendicular directions. The bale 2 is driven in one of said directions when moved from the first roller path 1 to the turntable 4, and in the other of said directions when moved from the turntable 4 to the second roller path 5. In between these movements the turntable 4 has been rotated through 90°, so that the steel wires 3, which in positions A and B are located in the transporting direction of the roller path 1, are now orientated in positions D and E so as to be at right angles to the transporting direction of the roller path 5.

Beneath the first roller path 1 there is arranged a first wire removal arrangement which incorporates a wire clipping device 6, (shown in FIG. 3), which can be moved vertically upwards in between two mutually adjacent rollers of the first roller path 1. When the bale 2 is located in the position A, the forwardly lying wrapping wire 3, which extends at right angles to the transporting direction, is located immediately above this wire removing arrangement. The forward wrapping wire 3 is severed by bringing the wire clipping device 6 into contact with the under surface of the bale 2. When the bale 2 is located in position B, its rearwardly lying wrapping wire 3 is located above the wire clipping device 6 and is severed in a similar manner. The wrapping wires 3 are moved, with the aid of an electromagnet (10, in FIG. 3), down from the under side of the bale 2 and into a wire winding arrangement (FIGS. 3–6).

A further wire clipping device 7, also illustrated symbolically in FIGS. 1 and 2 and corresponding with the aforedescribed wire clipping device, is arranged beneath the second roller path 5 and is active between two rollers of the second roller path 5, for removal of the remaining wrapping wires 3 of the bale 2 in positions D and E, in a manner similar to removal of the wire in the positions A and B.

The positions of the wires at locations A and B on the first roller path 1 and the wire positions at locations D and E on the second roller path 5 are determined with the aid of wire sensors 8, 9, which are located at each of said wire clipping devices 6, 7. When the bale 2 moves along respective roller paths 1, 5 and the forwardly located wrapping wire 3, as seen in the direction of transportation, is detected by the wire sensor 8, 9, the drive to the roller path 1, 5 is disengaged, wherewith the forward wire 3 is located above a respective wire clipping device 6, 7. When the bale 2 is again set in motion, the drive is disengaged when the rearwardly lying wire is detected by the wire sensor 8, 9, whereupon the rear wire is located above a respective wire clipping device 6, 7.

The wrapping wire removing arrangement will now be described with reference to FIG. 3. The reference numeral 20 identifies a horizontal lower part of a magnetic metal wire which is shown in broken lines and which is wound in an endless loop around a bale (not shown) resting on a horizontal roller path or some other form of conveyor (also not shown) which enables the part 20 to be reached from beneath. The reference numeral 6 identifies conventional shears driven by a pneumatic piston-cylinder device 21. The shears 6 and the piston-cylinder device 21 are securely mounted on a slide 22, which can be displaced axially along vertical guides 23 by means of a further pneumatic piston-cylinder device 24. The piston-cylinder device 24 and the guides 23 are carried by a machine frame structure 25, and the piston-cylinder device 24 is operative in moving the shears 6 between (a) an upper position, in which each of the shear blades is located on a respective side of the wire part 20, so as to sever said wire part upon activation of the piston-cylinder device 21, and (b) a lower position in which the shears are located out of the path of the bales located on the conveyor.

Figure 3:
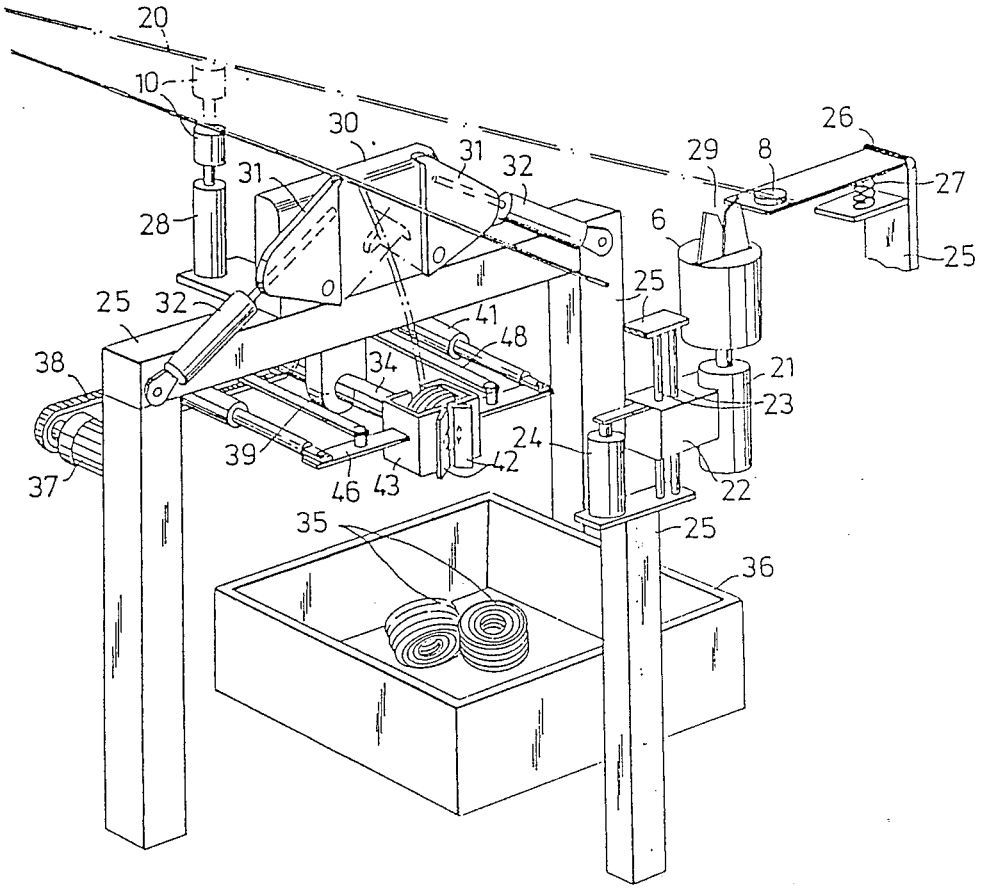
FIG. 3 is a perspective view of a wrapping wire removal arrangement used in the plant illustrated in FIGS. 1 and 2 and incorporating a wire coiling arrangement according to the invention.

Also incorporated in the arrangement illustrated in FIG. 3 is a sensor 8, which for the sake of simplicity is here considered to be located beneath the conveyor path and which is mounted on an arm which extends in the transporting direction of the conveyor and which is hinged at one end to the frame structure 25, by means of a hinge 26. A thrust spring 27 acting between the frame structure and the arm urges the arm into contact with the under surface of the bales advanced on the conveyor. The sensor is adapted to detect the presence of the magnetic metal wires and upon detecting such a wire is operative in initiating a sequence of operations in which the conveyor is stopped, the shears 6 are moved upwardly to their raised position by means of the piston-cylinder device 24, the piston-cylinder device 21 is activated to effect severing of the wire loop, and the shears 6 are again lowered to their lower position.

The electromagnet 10 of the illustrated embodiment is carried on the outer end of the piston rod of a pneumatic piston-cylinder device 28, which in turn is carried by the frame structure 25. The magnet 10 is arranged for movement between an upper position, shown in broken lines, in which it is located in the close proximity of or in physical contact with the wire part 20, and a lower position, shown in full lines, in which it is moved out of the path of the bales located on the conveyor. As the magnet 10 moves from its upper to its lower position, it entrains, or pulls, the left-hand part of the wire part 20 (as seen in FIG. 3) severed at 29, such as to bring this severed wire part into abutment with a support 30 carried by the frame structure 25. The support 30 has journalled thereon two wire-capturing arms 31, each of which is arranged for rotational movement between the open position shown in full lines, in which the wire end can pass freely in between the arms, and the holding-down position shown in broken lines, in which the captured part of said wire end is bent down in such a manner that the extremity of said captured wire-end is located in the slot 33 of a coiling mandrel 34 forming part of a wire coiling arrangement, the function and construction of which will best be seen from FIGS. 4–7. The coils of wire 35 wound by the wire coiling arrangement are collected in a container 36. The mandrel 34 is driven by an electric motor 37, via a V-belt transmission 38. The reference 39 identifies a bearing which is carried by the frame structure 25 and in which the mandrel 34 is journalled for rotation but prevented from moving axially. The wire receiving slot which extends rearwardly from the forward end of the mandrel 34 has a mouth part 40, or entrance, which widens towards said end. The motor 37 is arranged, in a known manner, to stop in a pre-determined position when the motor is switched off, so that the slot 33 will be oriented essentially in a vertical pane, as seen in FIGS. 3–7.

Figure 4:
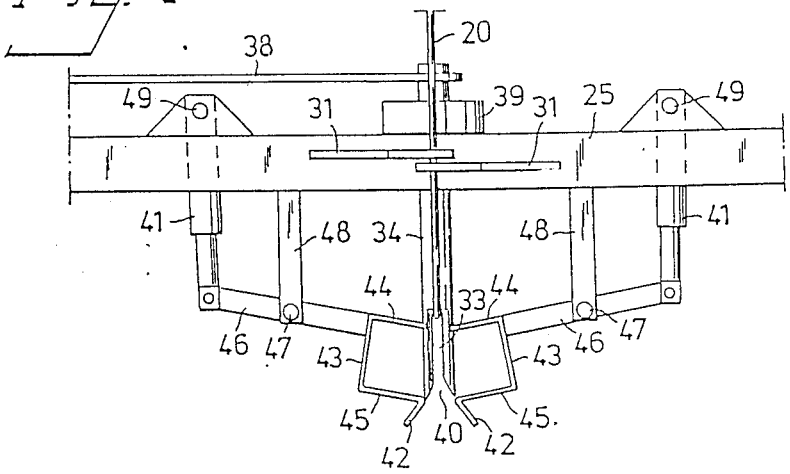
FIGS. 4–6 are views from above of a wire coiling arrangement similar to that illustrated in FIG. 3, showing the arrangement located in a wire receiving position, a wire coiling position and a coil ejecting position respectively.
Figure 5:
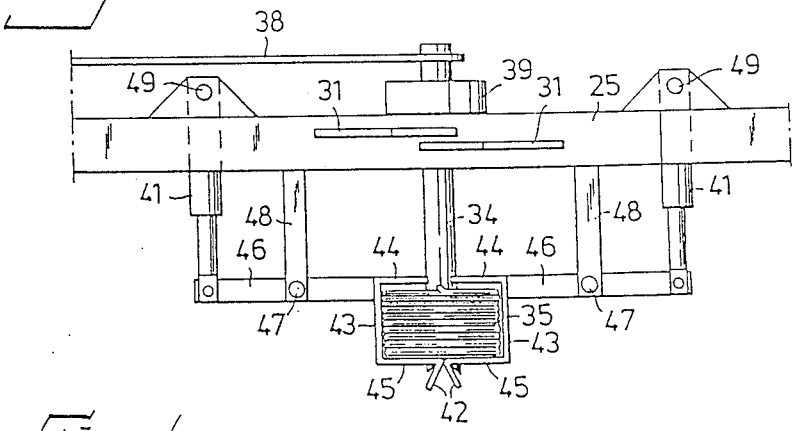
Figure 6:
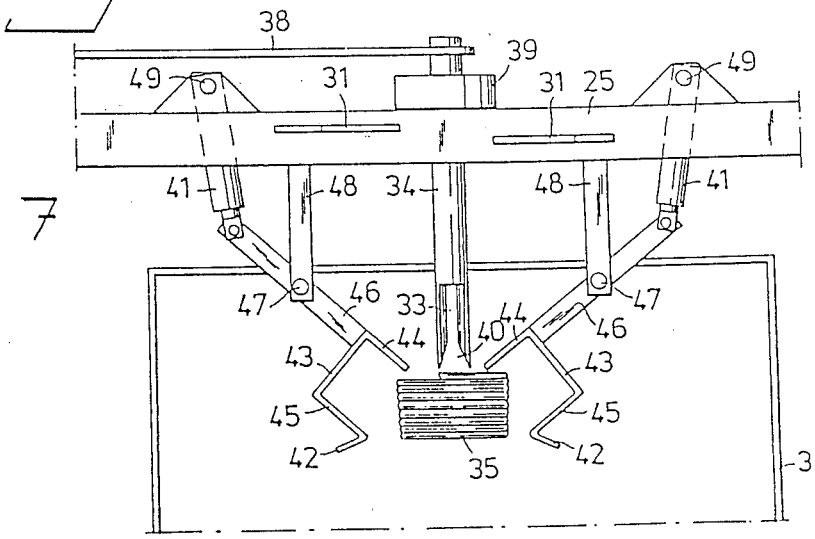

The wound coils of wire 35 are ejected or pushed from the mandrel 34 by means of a coil ejecting device which can be moved along the mandrel 34 by pneumatic piston-cylinder devices 41 between a retracted, wire coiling position, shown in FIG. 5, and a forwardly located, coil ejecting position, shown in FIG. 6. The coil ejecting device carries wire guides 42 which, when the coil ejecting device is set in the position illustrated in FIG. 4, form a widened or flared extension of the mouth 40 of the aforesaid slot 33, in a direction away from the forward end of the mandrel. These guides ensure that the wire part 20 is guided positively into the slot 33, when the wire capturing arms 31 are swung from the position shown in full lines in FIG. 3 to the position shown in chain lines, as also seen from FIG. 4.

The illustrated coil ejecting device includes two substantially U-shaped elements which are located on respective sides of the mandrel 34 and each of which comprises a web 43 and rear and front limbs 44 and 45 respectively. Each of the elements 43–45 is supported at one end by a respective arm 46. Each arm 46 is journalled at a location midway between its ends for pivotal movement about a pivot pin 47 located in an arm 48 which is carried, in turn, by the frame 25. The pivot pins 47 are mutually parallel and are located equidistant from the mandrel 34 in a plane extending transversely to the mandrel. Each of the ends of the arms 46 remote from the elements 43–45 is pivotally journalled on one end of a respective piston-cylinder device 41, the opposite ends of which are pivotally journalled to the frame structure 25 at 49.

The elements 43–45 with associated wire guides 42 can thus be moved in a circular arcuate path around the pivot pins 47 by the piston-cylinder devices 41, between the wire coiling position shown in FIG. 5 and the coil ejecting position shown in FIG. 6, via the intermediate position shown in FIG. 4. The web 43 extends substantially parallel with the mandrel 34 in said wire coiling position, at a distance from the mandrel axis corresponding to the largest desired radius of the wire coil 35 wound on the mandrel. The free inner ends of the limbs 44, 45 extending inwardly towards the mandrel 34 substantially at right angles to the opposing ends of the web 44 are suitably provided with recesses so configured as to conform to the outer surface of the mandrel, while leaving a small space between said limbs and said outer surface. In the wire coiling position of the arrangement, the forwardly located limbs 45, or at least the free ends thereof, are located essentially in a plane which extends transversely to the mandrel 34 and which is located closely adjacent to or slightly behind the forward end of the mandrel. An advantage is afforded when the lengths of respective limbs 44, 45 is such that the free ends of said limbs meet on both sides of the mandrel 34 in the wire coiling position of the arrangement, as illustrated for the limbs 45 in FIG. 5. The wire guides 42 consist of parts which extend obliquely outwardly and rearwardly in relation to the forwardly located limbs 45, preferably such as to subtend between said parts, in the wire receiving position according to FIG. 4, an angle of 60°–100°.

The free ends of the rearwardly located limbs 44 are preferably located in or adjacent to the plane containing the pivot pins 47, so that the elements 43–45 and their respective parts will not approach the axis of the mandrel to any great extent during movement of said elements and said parts from the wire coiling position to the coil ejection position.

In the intermediate position or wire receiving position illustrated in FIG. 4, the free ends of the forwardly located limbs 45 are advantageously located in a plane which extends perpendicularly to the mandrel axis and which contains the forwardly located end of the mandrel, this plane being spaced from the mandrel axis through a distance corresponding to half the width of the slot mouth 44, said continuations being spaced widely apart.

Figure 7:
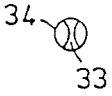
FIG. 7 is an end view of the coiling mandrel seen from the front.

FIG. 7 is a cross-sectional view of the mandrel 34, showing that the diametrical slot 33 widens towards the periphery of the mandrel. Consequently, the position of the slot 33 in relation to the vertical plane in the wire receiving position of the arrangement illustrated in FIG. 4 is less critical.

When using the wire coiling arrangement, the elements 43–45 are first set to the wire insertion position illustrated in FIG. 4. Subsequent to the insertion of the wire 20 into the slot 33, the elements 43–45 are withdrawn to the wire coiling position shown in FIG. 5, whereupon the mandrel 34 is rotated so as to wind the wire 20 thereon, therewith forming a coil 35. Subsequent to forming the coil 35, the elements 43–45 are moved to the coil ejection position shown in FIG. 6, while pushing the coil 35 axially from the mandrel 34 with the aid of the rearwardly located limbs 44, which act on the rear surface of the coil 35.

The invention is not restricted to the aforedescribed and illustrated embodiment, but can be achieved in any suitable manner within the scope of the invention defined in the following claims.

We claim:

1. A wire coiling arrangement comprising a rotatable wire coiling mandrel (34) which incorporates a wire receiving slot (33) which extends at least substantially axially rearwards from a forward end of the mandrel and which has a slot mouth (40) which faces said forward end of the mandrel, and further comprising an ejection arrangement (43–46) which can be moved between a withdrawn wire coiling position (FIG. 5) and a forwardly located coil ejection position (FIG. 6), such as to push a wire coil (35) coiled on the mandrel axially therefrom, characterized in that the coil ejection arrangement (43–46) is arranged for axial movement along the mandrel (34) and, for the purpose of facilitating insertion of a wire (20) into the wire receiving slot (33), carries wire guides (42) which in one setting (FIG. 4) of the ejection arrangement form a continuation of the slot mouth (40) which widens in a direction away from the forwardly located end of the mandrel.

2. An arrangement according to claim 1, characterized in that the slot mouth (40) is also widened in a direction towards the forward end of the mandrel.

3. An arrangement according to claim 1, characterized in that the coil ejection arrangement (43–46) includes two substantially U-shaped elements which are located on respective sides of the mandrel and each of which has a web (43) which, in said wire coiling position, extends in substantially parallel spaced relationship with the mandrel (34), and a forward and a rearward limb (45, 44) whose free ends distal from the web are located adjacent the outer surface of the mandrel in the wire coiling position of the arrangement; in that in the wire coiling position of the arrangement the free ends of the forwardly located limbs (45) of respective U-shaped elements are located in the proximity of the forward end of the mandrel, and in that each wire guide (42) consists of a guide part which extends obliquely outwards and rearwards from the free end of the forwardly located limb (45).

4. An arrangement according to claim 3, characterized in that the elements (43–45) are movable between the wire coiling position and the coil ejection position in circular arcuate paths about a respective one of two mutually parallel pivot pins (47) which extend equidistant from mutually opposite sides of the mandrel (34) in a plane extending perpendicularly to said mandrel.

5. An arrangement according to claim 4, characterized in that in the wire coiling position of the arrangement the free ends of the rearwardly located limbs (44) are located in or adjacent said plane.

6. An arrangement according to claim 5, characterized in that in the wire coiling position of the arrangement the free ends of the forwardly located limbs (45) meet behind the slot mouth (40) on both sides of the mandrel (34).

7. An arrangement according to claim 6, characterized in that the U-shaped elements (43–45) can be set to an intermediate position (FIG. 4) in which the free ends of the forwardly located limbs (45) are located in a plane which extends substantially at right angles to the axis of the mandrel and which contains the forward end of said mandrel, at a distance from said axis corresponding to half the width of the slot mouth (40).

* * * * *